US008005249B2

(12) United States Patent
Wirola et al.

(10) Patent No.: US 8,005,249 B2
(45) Date of Patent: Aug. 23, 2011

(54) EAR CANAL SIGNAL CONVERTING METHOD, EAR CANAL TRANSDUCER AND HEADSET

(75) Inventors: Lauri Wirola, Tampere (FI); Leo Kärkkäinen, Helsinki (FI)

(73) Assignee: Nokia Corporation, Espoo (FI)

( * ) Notice: Subject to any disclaimer, the term of this patent is extended or adjusted under 35 U.S.C. 154(b) by 1390 days.

(21) Appl. No.: 11/305,695

(22) Filed: Dec. 16, 2005

(65) Prior Publication Data

US 2006/0159297 A1 Jul. 20, 2006

(30) Foreign Application Priority Data

Dec. 17, 2004 (FI) ..... 20041625

(51) Int. Cl.
*H04R 25/00* (2006.01)

(52) U.S. Cl. ..... 381/326; 381/380; 381/190

(58) Field of Classification Search ..... 381/326, 381/328, 380, 151, 173, 190; 379/430, 420.02, 379/420.03; 600/25; 607/56, 57
See application file for complete search history.

(56) References Cited

U.S. PATENT DOCUMENTS

| | | | | |
|---|---|---|---|---|
| 3,764,748 | A * | 10/1973 | Branch et al. | 607/57 |
| 4,025,734 | A * | 5/1977 | Aloupis | 381/151 |
| 4,150,262 | A | 4/1979 | Ono | 179/107 |
| 4,588,867 | A * | 5/1986 | Konomi | 379/430 |
| 4,696,045 | A | 9/1987 | Resenthal | 381/114 |
| 4,776,322 | A * | 10/1988 | Hough et al. | 381/326 |
| 5,447,489 | A * | 9/1995 | Issalene et al. | 600/25 |
| 6,408,081 | B1 | 6/2002 | Boesen | 381/312 |
| 6,643,378 | B2 * | 11/2003 | Schumaier | 381/326 |

FOREIGN PATENT DOCUMENTS

| | | |
|---|---|---|
| DE | 3723275 | 3/1988 |
| JP | 2004208220 | 7/2004 |

* cited by examiner

*Primary Examiner* — Huyen D Le
(74) *Attorney, Agent, or Firm* — Harrington & Smith

(57) ABSTRACT

A method of converting electrical signals into mechanical vibration by means of a transducer in the human ear, an ear canal transducer and a headset wherein a sensation of hearing is achieved by exciting the tissue of the ear canal directly with said transducer, whereby the vibrations propagate to the tympanic membrane and into the human sound sensing organs.

14 Claims, 2 Drawing Sheets

EAR CANAL SIGNAL CONVERTING METHOD, EAR CANAL TRANSDUCER AND HEADSET

FIELD OF THE INVENTION

The present invention relates to a method of converting electrical signals into mechanical vibration in an ear canal. The present invention also relates to a method of converting mechanical vibration into electric signals in an ear canal.

The present invention further relates to an ear canal transducer. The present invention further relates to a headset for electronic devices, such as mobile phones, with an ear canal transducer suitable for a connection to an electronic device.

BACKGROUND OF THE INVENTION

Headsets are used as loudspeakers to listen to sound produced by a wide variety of electronic audio devices. Examples of such devices that are used with a headset are a broadcast radio receiver, a CD Player, an MP3 player, two way radio, mobile phone and television receiver. A headset can be connected to the audio device by a cable or with a wireless connection such as Bluetooth, DECT, or another wireless technology. Wireless connections can be used to free the user from being tied directly to the audio device by a cable. A headset typically includes an audio transducer worn close to the ear. In case the headset provides audio for both ears, the headset has a pair of transducers, one for each ear. The headset also includes any additional electronics required to connect the headset to the audio device the user wishes to listen to, and optionally, additional user interface (UI) features such as a volume control. In case of a wireless headset, a battery, a solar cell or another power source is required to power the headset. A headset may also include electronics used to modify sound by the means of DSP (Digital Signal Processing).

Typical headsets use conventional loudspeakers utilizing normal air conduction by exciting pressure waves in the volume of tympanic canal, which waves travel along the canal and ultimately excite the tympanic membrane producing sensation of hearing. A well-known headphone type based on air conduction principle is placed over the ear and transmits sound to the user via the air canal. Microphones are correspondingly based on the detection of pressure changes or pressure gradients. Especially in loudspeakers this technology results in relatively low efficiency and, hence, in relatively high power consumption. Moreover, these headsets are adversely affected by the ambient noise. In addition to the low-efficiency of loudspeakers, another matter reducing the efficiency significantly is the air-tissue interface at the tympanic membrane. This interface is not ideal, and further gains in efficiency may be achieved by not going to the pressure domain at all.

It is further known to use bone conduction to transmit the sound, whereby especially the background noise can be reduced. U.S. Pat. No. 6,408,081 B1 discloses a bone conduction voice sound transmitting apparatus including an earpiece that is adapted for insertion into the external auditory canal of a user, the earpiece having both a bone conduction sensor and an air conduction sensor. The bone conduction sensor is adapted to contact a portion of the external auditory canal to convert bone vibrations of voice sound information into electrical signals. The air conduction sensor resides within the auditory canal and converts air vibrations of the voice sound information into electrical signals. The voice sound transmitting apparatus also includes a speech processor and transmitter. The speech processor samples the output from the bone conduction sensor and the air conduction sensor. In comparing the sampled output, the speech processor is able to filter noise and select the pure voice sound signal for transmission. The transmission of the voice sound signal may be through a wireless linkage. In addition, the bone conduction sensor and the air conduction sensor are preferably designed so as not to occlude the external auditory canal. The apparatus in U.S. Pat. No. 6,408,081 B1 may also be equipped with a speaker and receiver to enable two-way communication. The voice sound transmitting unit further includes a casing having an ear attachment portion and a fitting portion that connects the ear attachment portion with the bone conduction sensor and the air conduction sensor. The ear attachment portion is contoured to fit over and behind the upper ear lobe of the user and is preferably made of a lightweight aluminium or plastic material. It can be appreciated that the primary purpose of the ear attachment portion is to secure the voice sound transmitting unit in proper position. The fitting portion is integral with the ear attachment portion. The voice sound transmitting apparatus is fit so that the bone conduction sensor is in contact with a portion of the external auditory canal. The bone conduction sensor rests against the posterior superior wall of the external auditory canal, with the fitting portion shaped to bias the bone conduction sensor into position.

The apparatus in U.S. Pat. No. 6,408,081 B1 is relatively uncomfortable in use, especially due to the hard material of the ear attachment portion. Further, it is relatively difficult to insert the apparatus into the right position, and relatively much energy is required in order to achieve a enough strong impact to excite a bone.

SUMMARY OF THE INVENTION

It is an object of the present invention to eliminate the disadvantages of the prior art and to provide an improved method of and ear canal transducer, hereinafter called an Ear Canal Exciter (ECE), for converting electrical signals into mechanic vibration. The present invention is based on the idea that the (soft) tissue (skin) of the ear canal is excited directly in order to produce tissue vibrations and further a sensation of hearing as the outer layer tympanic membrane actually is continuous with the skin of the outer ear canal.

The transducer according to the present invention discloses a little earpiece adapted to be inserted into the ear canal. The earpiece has one or arbitrary number of thin, typically 50 μm thick transducer element stripes, such as piezoelectric (e.g. multilayered prestressed elements, single crystals, polymers or ceramic-polymer composites) elements that are applied to a rigid cylindrical ear-attachment body. However, other shapes of transducer elements are not excluded. Elastic material surrounds the transducer stripes and, hence, the whole body. The elastic material mentioned in the last sentence will provide a) protection for the thin elements and b) optimal impedance matching to the ear canal tissue in order to maximize the efficiency of the device. The excitation type may be electrostrictive (i.e. piezoelectric), magnetostrictive, inductive or electrodynamic.

The thin stripes may be excited in the same phase or in different phases. Moreover, some of them may be excited while the others are working in a microphone mode.

In a vibration inducing mode corresponding loudspeaker use the transducer couples directly to the ear canal walls and induces compressional and Rayleigh waves. These waves propagate in the soft tissues of the ear canal towards the tympanic membrane which starts to vibrate and, hence, produce a sensation of sound in the user's ear. Such a method to transmit sound is much more efficient than the prior art described above. The transducer can due to the cylindrical form of the elastic body have an opening in the centre and, hence, the device may be made transparent to the ambient sound. The transparency is an essential feature in, for instance, car use, when hearing external sounds is life-critical. This point is further emphasized when stereo hands-frees are used or when operating in binaural mode. However, the current invention does not exclude the use of ECE in a closed mode, when the system could also work as an ear plug. When operating in a high-noise environment, ECE might provide a means to have a phone call still retaining a good level of intelligibility.

The transducer can also operate in a vibration sensing mode like a microphone picking up signals from tissue vibrations originating from human sound production organs. This reduces essentially the background noise.

The present invention also discloses a headset for mobile phones etc. utilizing the transducer technology according to the present invention.

Characteristic features of the present invention are in detail presented in the enclosed claims.

The transducer device according to the present invention might also work as a hearing device for persons suffering from hearing loss. If, for instance, the ossicles movement is reduced, ECE might be able to provide strong enough stimulus so that hearing could be possible. In a hearing device application the electronics might also include an external microphone sensing air-borne sounds.

As there is microphone functionality included in the ECE, it could also be utilized in detecting heart beat. This could be either a fun-feature or a real application.

BRIEF DESCRIPTION OF THE DRAWINGS

The foregoing, and additional objects, features and advantages of the present invention will be more clearly understood from the following detailed description of preferred embodiments of the present invention, taken in conjunction with accompanying drawings, in which.

DETAILED DESCRIPTION OF THE INVENTION

Figure 1:
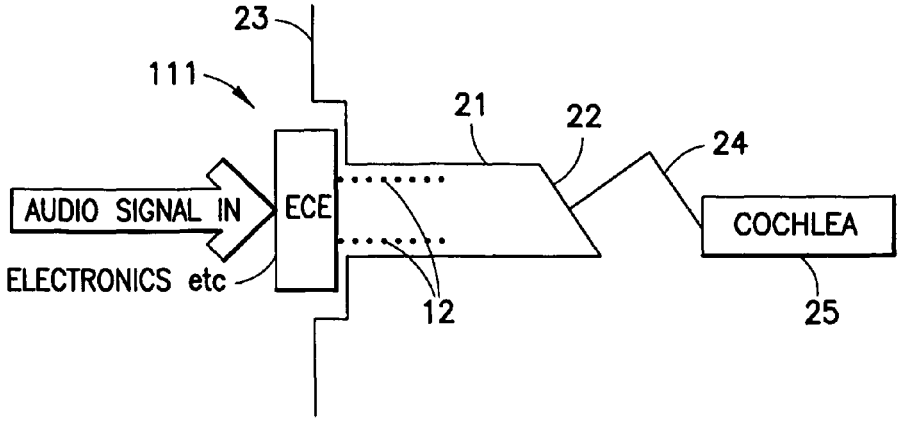
FIG. 1 is a schematical view of a Ear Canal Exciter headset provided with an acoustic ear canal transducer according to the present invention.

FIG. 1 shows a schematical view of an Ear Canal Exciter (ECE) headset 1 provided with an electronic unit 11 and an ear canal transducer 12 according to the present invention. An ear canal transducer according to the present invention has a form of a cylindrical (FIG. 2) earpiece adapted for insertion into the (external) ear canal 21 in the user's ear 2 (including further a tympanic membrane 22, pinna 23, ossicles 24 and cochlea 25) and adapted to contact the ear canal in order to excite the skin of the ear canal directly in order to produce tissue vibrations, thus transmitting the sound by conducting from a soft tissue in the outer ear canal into the tympanic membrane 22 and further to the sound sensing organs, and thus produce a sensation of hearing.

The transducer 12 is inserted to the ear canal 21 of the user, preferably at the mouth of tympanic canal, directly after the concha or at the interface of concha and tympanic canal. The transducer 12 has a cylindrical form (or some other suitable curved form that fits into the ear canal) and vibrates in a radial fashion. The electronic unit 11 attached to the vibrating transducer includes at least an amplifier, power source and a Bluetooth chip when the connection to the electronic device, such as a mobile phone, is wireless. Electronics may also include some DSP, although DSP may be in the electronic device.

Figure 2A:
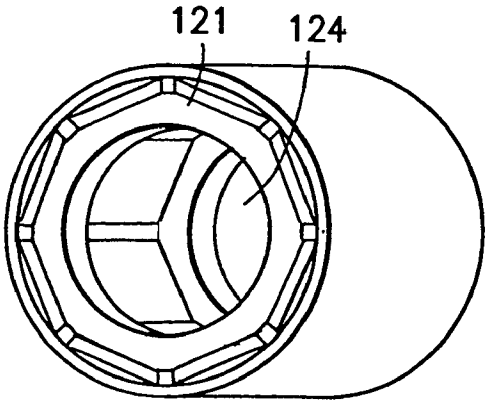
FIGS. 2*a* and 2*b* present a perspective view of a piezoelectric acoustic ear canal transducer according to the present invention.
Figure 2B:
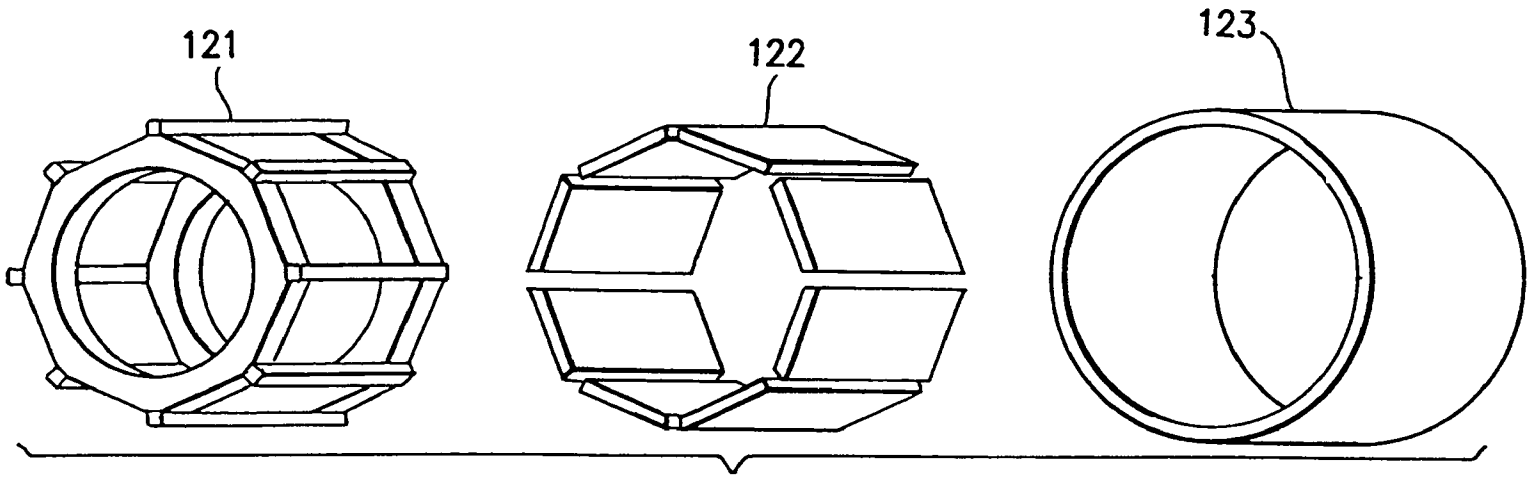

FIGS. 2*a* and 2*b* show an exemplary implementation of the transducer unit 12. It includes a rigid plastic inner frame 121 with cylindrical inner side and the outer side having eight plane surfaces for attachment of the piezoelectric transducer film elements 122 arranged round the frame 121. The transducer has further an outer protective cylindrical mantle 123 of elastic plastic material. The cylindrical form of the transducer makes it possible to insert it into the ear canal 22 touching the ear canal tissue (skin), and further, with an opening 124 in the centre, the ambient sound can also propagate into the tympanic membrane. The transducer is further provided with connecting cables connecting the transducer to the electronic unit 11. If the device is non-wireless, one also needs wires to connect the device to the electronic device.

In a vibration inducing mode the piezoelectric film elements are controlled with the electronic unit to produce radial vibration on the basis of the electric signals from the electronic unit 11. The outer protection protects the piezoelectric elements, but provides also the impedance matching to the soft tissue in the ear canal 21.

The exciter can also be used in a vibration sensing mode corresponding thus a microphone. The advantage in the vibration sensing mode is the capability to avoid ambient noise, as the signals are picked up from the tissue vibration and not from the air. Air-borne noise does not propagate into tissues.

Figure 3A:
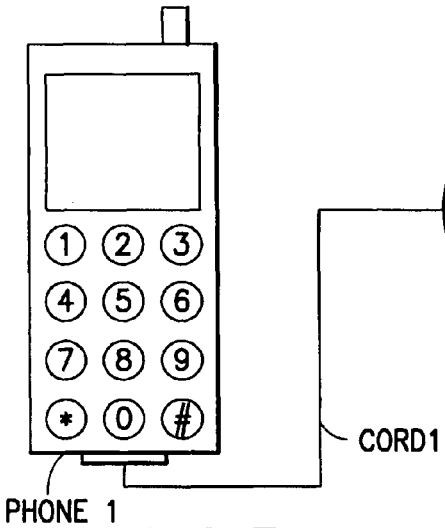
FIGS. 3*a* and 3*b* present two different embodiments of use of the ear Canal Exciter according to the present invention connected to a mobile device.
Figure 3B:
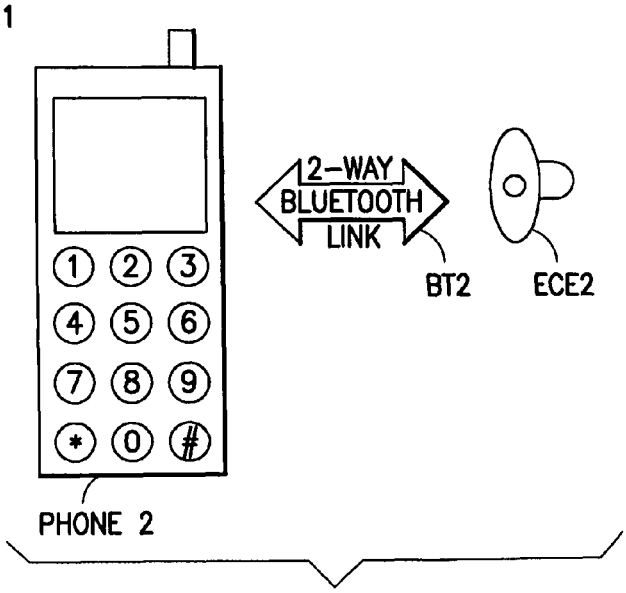

FIGS. 3*a* and 3*b* present different embodiments of the present invention used as a headset. In FIG. 3*a* the Ear Canal Exciter ECE1 is used as a handsfree device at the end of cord CORD1. All the signal processing is performed in the phone PHONE1. Power is fed through the cable to the exciter ECE1. This usage case also includes the use of two ECEs connected to the same phone. Such functionality is required for binaural technology.

In FIG. 3*b* ECE as a cordless handsfree device ECE2. Signal processing is performed in the phone PHONE2 and the processed signal is fed through a bluetooth BT2 link to the exciter ECE2. The downlink is used for microphone functionality. In wireless case, the exciter ECE2 has its own power source. This usage case also includes the use of two ECEs connected to the same phone. Such functionality is required for binaural technology.

It is obvious to the person skilled in the art that different embodiments of the invention are not limited to the example described above, but that they may be varied within the scope of the enclosed claims. Also other transducers can be used with the present invention, including the magnetic type, electret condenser type, IC type, and semi-conductor type transducers. Further, the transducer body is not necessary cylindrical; also other curved forms capable of being inserted without any specific attachment means are possible. The "rigid frame" may also be a non-rigid body that would allow for more comfortable insertion of the device in the ear canal as well as ensure good coupling and use-comfort. Although the main purpose is to excite the ear drum directly, some of the vibration induced may still "leak" directly to the ossicles or even to the cochlea. The excitation may also be axial, even angular (all the degrees of freedom in a cylindrical system of coordinates, or a combination of them.

The invention claimed is:

1. A method of converting electrical signals into mechanical vibration by means of a curved transducer in an outer ear canal, wherein the curved transducer comprises a curved inner member, a curved outer member, and at least one transducer element between the curved inner member and the curved outer member, characterised in that a sensation of hearing is achieved by exciting the tissue of the outer ear canal directly with said transducer, whereby the vibrations propagate from the outer ear canal to the tympanic membrane and into the human sound sensing organs.

2. A method according to claim 1, wherein the excitation is electrostrictive, magnetostrictive, inductive or electrodynamic.

3. A method according to claim 1, wherein the excitation is performed by a transducer being insertable into the outer ear canal and touching the outer ear canal tissue, wherein the at least one transducer element comprises a plurality of transducer elements configured to generate a radial vibration operation on the outer ear canal tissue.

4. A method as in claim 1 wherein the at least one transducer element is configured to produce a radial vibration, and wherein the at least one transducer element is located proximate an outer perimeter of the curved transducer.

5. An apparatus comprising an ear canal transducer configured to convert electrical signals into mechanical vibration in the human ear, the ear canal transducer having a form of an earpiece adapted for insertion into the outer ear canal, characterised in that in order to transmit sound and achieve a sensation of hearing the transducer excites the tissue of the outer ear canal, whereby the vibrations propagate from the outer ear canal to the tympanic membrane and into the human sound sensing organs, wherein the ear canal transducer comprises a frame member and a transducer element, and wherein the transducer element is disposed on an outer curved surface of the frame member.

6. An ear canal transducer according to claim 5, wherein the transducer has a curved outer body of elastic material adapted for elastic fitting in the outer ear canal without any specific attaching means.

7. An ear canal transducer according to claim 5, wherein the transducer element further comprises a plurality of piezoelectric transducer film elements arranged on the outer curved surface of the frame member in such an arrangement that they are able to generate a radial, axial and/or angular vibration operation.

8. An ear canal transducer according to claim 5, wherein the transducer has an opening in the centre in order to be made transparent to the ambient sound.

9. An ear canal transducer according to claim 5, wherein the transducer is closed.

10. An ear canal transducer according to claim 5, wherein the transducer elements are of piezoelectric type, magnetic type, electret condenser type, IC type, semi-conductor type or inductive type.

11. An apparatus as in claim 5 wherein the frame member comprises an annular shape with an opening extending therethrough, wherein the transducer further comprises an outer member having an annular shape, and wherein a plurality of transducer elements are disposed between the outer curved surface of the frame member and an inner curved surface of the outer member.

12. An apparatus comprising electronic circuitry configured for signal processing, and a power source, wherein the apparatus is configured to be connected to an electronic device, the apparatus further comprising, an ear canal transducer configured to convert electrical signals into mechanical vibration in the human ear, the ear canal transducer having a form of an earpiece adapted for insertion into the outer ear canal, characterised in that in order to transmit sound and achieve a sensation of hearing the transducer excites the tissue of the outer ear canal, whereby the vibrations propagate from the outer ear canal to the tympanic membrane and into the human sound sensing organs, wherein the ear canal transducer comprises transducer elements substantially circumferentially spaced about an opening of the ear canal transducer, wherein the transducer elements are configured to be controlled by the electronic circuitry to produce the mechanical vibrations corresponding to electric signals from the electronic circuitry.

13. An apparatus according to claim 12, wherein the apparatus is headset for an electronic device.

14. An apparatus according to claim 12, wherein the electronic circuitry comprises an amplifier, a Digital Signal Processor (DSP), and a connection to the electronic device.

* * * * *